US007217029B2

(12) United States Patent
Grandjean

(10) Patent No.: US 7,217,029 B2
(45) Date of Patent: May 15, 2007

(54) MIXER WITH LUMP BREAKER HAVING MULTIPLE AXES OF ROTATION

(75) Inventor: Michel Grandjean, Andrezel (FR)

(73) Assignee: Hognon SA, Mormant Country (FR)

( * ) Notice: Subject to any disclaimer, the term of this patent is extended or adjusted under 35 U.S.C. 154(b) by 187 days.

(21) Appl. No.: 10/788,788

(22) Filed: Feb. 26, 2004

(65) Prior Publication Data

US 2005/0190646 A1 Sep. 1, 2005

(51) Int. Cl.
*B01F 7/30* (2006.01)
*B01F 9/08* (2006.01)

(52) U.S. Cl. ..... 366/287; 366/224; 366/292

(58) Field of Classification Search ..... 366/287–288, 366/297–300, 292, 64–67, 92–99, 326.1, 366/224
See application file for complete search history.

(56) References Cited

U.S. PATENT DOCUMENTS

| | | | | | |
|---|---|---|---|---|---|
| 1,438,281 | A * | 12/1922 | Westerman | 366/287 |
| 1,475,978 | A * | 12/1923 | Westerman | 366/287 |
| RE15,746 | E * | 1/1924 | Westerman | 366/287 |
| 2,539,436 | A * | 1/1951 | Kost | 416/76 |
| 3,126,196 | A * | 3/1964 | Staeger | 366/287 |
| 3,746,314 | A * | 7/1973 | Nauta | 366/170.2 |
| 3,799,917 | A * | 3/1974 | Rathke | 526/88 |
| 4,057,226 | A * | 11/1977 | de Mos et al. | 366/244 |
| 4,065,811 | A * | 12/1977 | Pauty | 366/244 |
| 4,131,034 | A * | 12/1978 | Rolf | 475/11 |
| 4,281,934 | A * | 8/1981 | Krause et al. | 366/30 |
| 4,437,766 | A * | 3/1984 | Joachim | 366/287 |
| 4,438,634 | A * | 3/1984 | Merle et al. | 62/123 |
| 4,516,860 | A * | 5/1985 | van der Laan et al. | 366/287 |
| 4,820,054 | A * | 4/1989 | Wong | 366/287 |
| 5,123,748 | A * | 6/1992 | Schroer | 366/287 |
| 5,524,982 | A * | 6/1996 | Kruse et al. | 366/66 |
| 5,535,665 | A * | 7/1996 | Wong | 99/348 |
| 5,649,765 | A * | 7/1997 | Stokes et al. | 366/287 |
| 5,890,803 | A * | 4/1999 | Jolink | 366/170.3 |
| 6,227,697 | B1 * | 5/2001 | Stahl | 366/288 |
| 6,599,005 | B2 * | 7/2003 | Van Der Wel | 366/143 |
| 2005/0190646 | A1 * | 9/2005 | Grandjean | 366/287 |

FOREIGN PATENT DOCUMENTS

| | | | |
|---|---|---|---|
| DE | 1049672 | * | 1/1959 |
| DE | 2462443 | A1 * | 4/1977 |
| DE | 3508711 | A1 * | 9/1986 |
| EP | 0126437 | A2 * | 11/1984 |
| EP | 0192179 | A2 * | 8/1986 |
| EP | 0737507 | A2 * | 10/1996 |
| EP | 1050335 | A1 * | 11/2000 |

(Continued)

*Primary Examiner*—Charles E. Cooley
(74) *Attorney, Agent, or Firm*—Townsend and Townsend and Crew LLP

(57) ABSTRACT

A mixer is provided comprising: a casing (20) having symmetry of rotation about a first axis (13), mixing members (22) driven in rotation relative to the casing (20) and about a second axis (15) that is inclined relative to the first axis (13), the casing (20) and the mixing members (22) being driven in rotation about the first axis (13) at a determined speed. As mixing is performed just by the mixing members, mixing of the ingredients is controlled throughout the medium.

19 Claims, 7 Drawing Sheets

FOREIGN PATENT DOCUMENTS

| | | | | |
|---|---|---|---|---|
| FR | 403214 | | * | 10/1909 |
| FR | 892078 | | * | 3/1944 |
| FR | 1394217 | | * | 2/1965 |
| FR | 2336168 | | * | 7/1977 |
| FR | 2849788 | | * | 7/2005 |
| GB | 788142 | | * | 12/1957 |
| GB | 2237752 | A | * | 5/1991 |
| JP | 5-49892 | | * | 3/1993 |
| JP | 6-312123 | | * | 11/1994 |
| JP | 11-155730 | | * | 6/1999 |
| JP | 2000-107031 | | * | 4/2000 |
| JP | 2003-135950 | | * | 5/2003 |
| JP | 2005-262094 | | * | 9/2005 |
| SU | 1238783 | A1 | * | 6/1986 |
| SU | 1278237 | A1 | * | 12/1986 |
| SU | 1435448 | A1 | * | 4/1987 |
| SU | 1472111 | A1 | * | 4/1989 |
| SU | 1766485 | A1 | * | 10/1992 |
| SU | 1811416 | A3 | * | 4/1993 |
| WO | 88/01537 | A1 | * | 3/1988 |

* cited by examiner

MIXER WITH LUMP BREAKER HAVING MULTIPLE AXES OF ROTATION

BACKGROUND OF THE INVENTION

The present invention relates to a mixer and an apparatus comprising the mixer.

Mixers are used for mixing several components. The latter can be gaseous, liquid or solid and miscible or non-miscible. Mixing is an operation which occurs in all types of industry, which gives it considerable importance.

EP-A-0,325,865 discloses a mixer for mixing cooking ingredients. This mixer comprises a mixing device in the form of a recumbent U, comprising two upper and lower horizontal branches, connected to each other at one of their ends by a vertical branch. The lower horizontal branch comprises a vane for mixing the ingredients. The device is driven in rotation by a vertical shaft at the free end of the upper horizontal branch. The rotation of the recumbent U by the vertical shaft effects the rotation of the vane about a horizontal axis by a transmission in the U. This mixer has the drawback that the ingredients are not only mixed by the vane but also by the other branches of the U which beat the ingredients during their rotation about the vertical shaft. Consequently, mixing is difficult to control and not uniform.

FR-A-2,336,168 discloses a mixer. According to one embodiment, the mixer comprises a first, substantially vertical, shaft driven in rotation about its vertical axis and driving a second shaft about an axis that is inclined relative to the axis of the first shaft. The second shaft is driven by the first shaft via an angular member in the centre of a sphere. The second shaft carries a stirring member. A movement of the assembly about the axis of the vertical shaft can result only from the torque caused by the rotation of the stirring member about the second shaft. The drawback is that the rotation of the assembly about the axis of the vertical shaft is not controlled; the rotation is influenced by the quantity and viscosity of the ingredients in the vessel. Consequently, the mixing is difficult to control and not uniform.

SUMMARY OF THE INVENTION

There is therefore a need for a mixer which makes it possible to improve mixing.

For this purpose, the invention provides a mixer comprising:

- a casing substantially having symmetry of revolution about a first axis,
- mixing members driven in rotation relative to the casing and about a second axis that is inclined relative to the first axis, the casing and the mixing members being driven in rotation about the first axis at a determined speed.

According to one embodiment, the casing can comprise a cap driven in rotation about the second axis and supporting the mixing members.

According to one embodiment, the mixer can comprise a first drive unit for driving the casing and the mixing members about the first axis and a second drive unit for driving the mixing members about the second axis. In this case, the first and second drive units can be superposed along the first axis.

According to one embodiment, the second axis can be inclined relative to the first axis at an angle comprised between 45° and 90° in the trigonometric sense.

According to one embodiment, the mixing members can have an orientation which is variable relative to the second axis.

According to another embodiment, the mixing members can have an orientation which is fixed relative to the second axis.

Advantageously, the mixing members can have an extreme edge in the shape of an arc of a circle.

According to yet another embodiment, the mixer can comprise:

- a transmission tube driven in rotation about the first axis and carrying at one end the casing,
- a first shaft, in the transmission tube, driven in rotation about the first axis,
- a second shaft driven in rotation about the second axis by the first shaft, the second shaft driving in rotation the mixing members,
- a transmission connecting the first and second shaft, the transmission being in the casing, According to one embodiment, the mixing members can be open-worked vanes, solid vanes or cutters.

According to another embodiment, the mixer can comprise a lump breaker which is mobile relative to the first axis, the lump breaker and the mixing members being on either side of a plane containing the first axis.

Advantageously, the lump breaker can be mobile parallel to the first axis.

Preferably, the lump breaker can be along the second axis. In this case, the lump breaker can be connected to the transmission tube. For example, a telescopic arm can connect the lump breaker to the transmission tube.

Advantageously, the lump breaker can be driven in rotation by a motor in the telescopic arm.

The invention also relates to an apparatus comprising a mixer as described previously, and a container, the base of which has a symmetry of revolution and the generatrix of which is the extreme edge of a mixing member.

According to one embodiment, the apparatus can moreover have an inner cradle supporting the container and the mixer and mounted on an outer cradle in rotation about a diameter common to the inner and outer cradles, and a support, the outer cradle being mounted in rotation about a diameter on said support.

Other characteristics and advantages of the invention will become apparent on reading the detailed description which follows, of the embodiments of the invention, given by way of example only, and with reference to the drawings.

DETAILED DESCRIPTION OF PREFERRED EMBODIMENTS

The invention proposes, in order to improve the performance of known mixers, driving in rotation mixing members relative to a casing which has substantially a symmetry of revolution about an axis. The casing and the mixing members are also driving in rotation in the medium about said axis. In this way, the mixing members are responsible for mixing the ingredients and the mixing is controlled throughout the medium.

Figure 1:
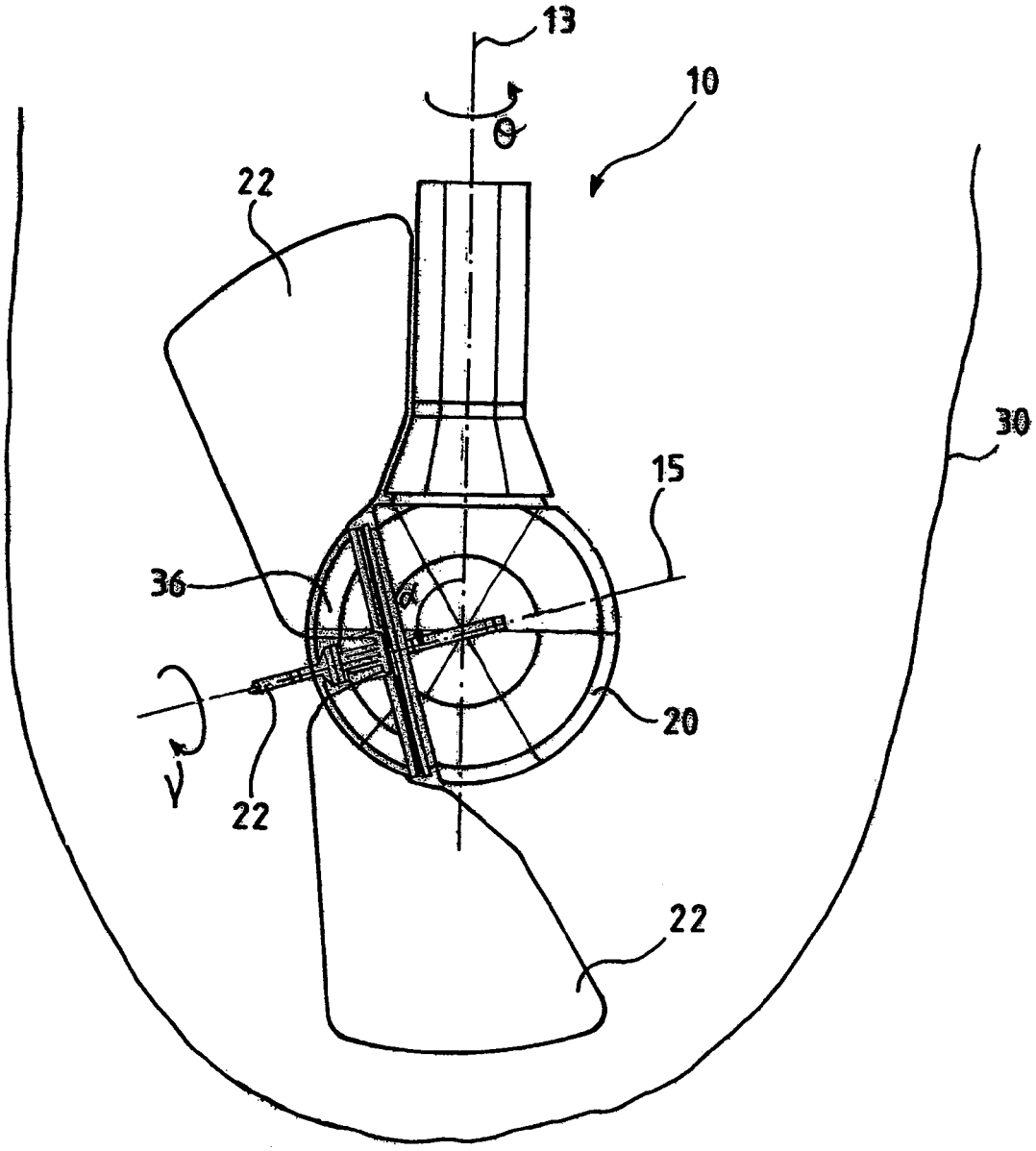
FIG. 1, a view of the mixer according to the invention.

FIG. 1 shows a view of the mixer 10, in a container 30. FIG. 1 shows the mixer 10 comprising a casing 20 leaving substantially symmetry of revolution about a first axis 13. The first axis 13 is substantially vertical. In the figure, the casing 20 is non-limitatively represented with a spherical shape. The mixer 10 also comprises mixing members 22 driven in rotation relative to the casing 20. The mixing members 22 are driven in rotation about a second axis 15 inclined at an angle α relative to the first axis 13. The casing 20 and the mixing members 22 are driven in rotation about the first axis 13 at a determined speed.

The mixing members 22 make it possible to beat the ingredients present in the container 30. The mixing members 22 are driven simultaneously about the second axis 15 in a rotation movement υ and about the second axis 13 in a rotation movement θ. This makes it possible, during the operation of the mixer 10, to improve the mixing of the ingredients throughout the container. The mixer makes it possible to avoid dead zones in the container 30 where the ingredients are not mixed.

The second axis 15 is inclined relative to the first axis 13 at an angle α comprised between 45° and 135° in the trigonometric sense. The inclination of the second axis 15 allows the mixing members to move in a zone situated vertical to the first axis 13 and to beat the ingredients which are found in this zone. This avoids leaving a dead zone below the first axis 13.

The casing 20 makes it possible to keep the mixing members 22 inside the container 30. The casing 20 encloses the means used for driving the mixing members 22. The casing 20 has substantially a symmetry of revolution about the first axis 13. Thus, the casing 20 does not have asymmetries such that, during the rotation of the casing 20 according to θ, the asymmetries would contribute to the mixing of the ingredients. The advantage of the invention is that the mixing members are responsible for the mixing. The mixing is thus better controlled.

In order to obtain better mixing, the casing 20 and the mixing members 22 are driven in rotation about the first axis 13 at a determined speed. The speed is determined in the sense that the user himself fixes the speed of rotation about the axis 13. The speed does not depend on the ingredients present in the container 30. The rotation about the axis 13 is not passive as the rotation is not engendered solely by the fact of the rotation of the mixing members 22. On the contrary, the rotation about the axis 13 is engendered by an active drive. Thus, contrary to the document FR-A-2 336 168, in which the rotation of the mixing members themselves causes the rotation of the assembly in the container, the rotation of the assembly according to the invention is fixed by the user. The rotation at a determined speed of the casing 20 and the mixing members 22 can be for example engendered by drive units as described above in connection with FIG. 2.

Figure 2:
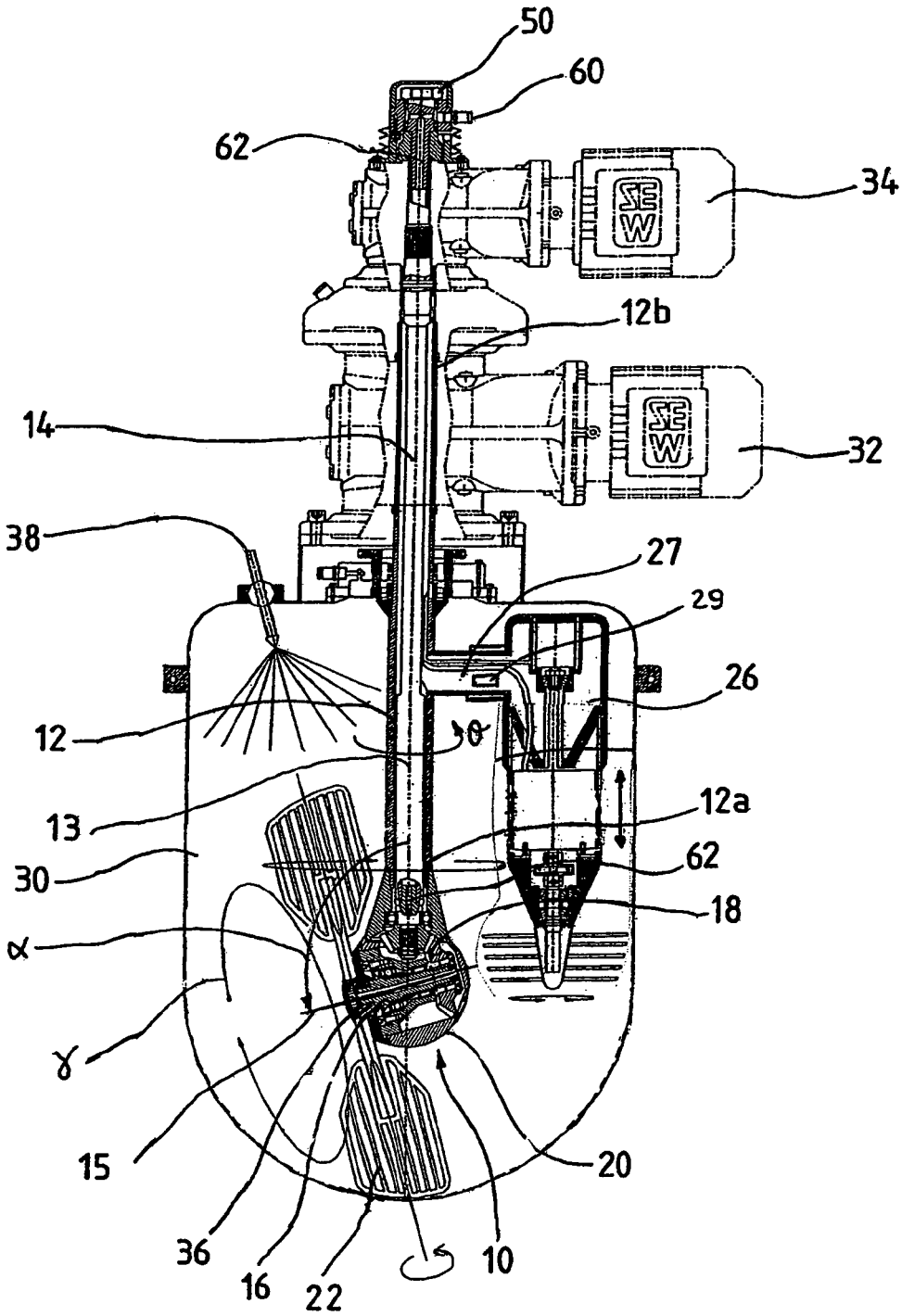
FIG. 2, a sectional view of the mixer of FIG. 1 according to one embodiment.

The driving of the casing 20 and the mixing members 22 will now be explained in more detail and in non-limitative fashion according to the embodiment of FIG. 2. FIG. 2 represents a sectional view of a mixer according to one embodiment.

FIG. 2 shows the various parts already described in FIG. 1. It shows in particular the first axis 13 and second axis 15, the casing 20 and the mixing members 22. Moreover, the mixer 10 comprises a transmission tube 12 driven in rotation about the first axis 13. The transmission tube 12 comprises at one end 12*a* the casing 20. In the transmission tube 12, a first shaft 14 is driven in rotation about the first axis 13. The mixer 10 comprises moreover a second shaft 16 driven in rotation about the second axis 15 by the first shaft 14. The second shaft 16 drives in rotation the mixing members 22. A transmission 18 connects the first shaft 14 and the second shaft 16 in such a way as to allow the driving of the shaft 16 by the shaft 14. The transmission 18 is in the casing 20.

Thus the rotation of the transmission tube engenders the rotation of the casing 20 and the mixing members 22 according to the movement referenced θ. The mixing members 22 are also driven in rotation according to the movement υ. The mixing members 22 are driven by this movement thanks to the rotation of the first shaft 14 driving in rotation the second shaft 16 by the transmission 18. The transmission tube 12 is driven in rotation by a drive unit 32, and the first shaft 14 is driven in rotation by a drive unit 34.

The first unit 32 drives the casing 20 and the mixing members 22 about the axis 13 and the second unit 34 drives the mixing members 22 about the axis 15. The units 32, 34 allow the casing 20 and the mixing members 22 to be driven at a determined speed. Thus, the determined speed of rotation of the casing 20 and the mixing members 22 makes it possible to improve the mixing of the ingredients.

Advantageously, the drive units 32, 34 are arranged one above the other in such a way as to facilitate the maintenance and cleaning of the mixer. For this purpose, the shaft 14 extends beyond the end 12*b* of the transmission tube 12 along the axis 13. This allows the unit 34 to drive the shaft 14 and allows the unit 34 to be arranged above the unit 32.

The superposed arrangement of the drive units 32, 34 makes it possible to dispense with bearings between the transmission tube 12 and the container 30. In fact, the drive unit 32 can be fixed to the container 30 itself, which allows the transmission tube to dip into the container without being guided relative to the container 30 by bearings.

Another advantage of the superposition is that the units 32, 34 directly drive the casing 20 and the mixing members 22 without the need for a belt or gear drive. The advantage is the ability to remove and replace the mixer more easily in order to carry out a maintenance operation. In fact, the unscrewing of a nut 50 at the top of the column comprising the drive units 32, 34 and the casing 20 allows this assembly to drop down and be maintained and cleaned.

The drive unit 32 is for example a motor which can drive the transmission tube up to a speed of 8 rpm. The drive unit 34 is for example a motor which can drive the shaft 14 up to a speed of 30 rpm.

According to one embodiment, the mixer 10 comprises a cap 36 supporting the mixing members 22. The cap 36 is driven in rotation about the second axis 15. The cap 36 is part of the casing 20 and fits into the symmetry of revolution of the casing 20 about the axis 13 so as not to disturb the mixing by the mixing members 22. The orientation of the mixing members 22 can vary relative to the second axis 15. The advantage is the ability to adjust the orientation of the mixing members as a function of the products to be mixed and in particular their viscosity. Preferably, the orientation of the mixing members is fixed relative to the second axis 15. For this purpose, the mixing members 22 can be made in one piece with the cap 36, the assembly being obtained for example by moulding. The advantage is that the moulding of the assembly makes it possible to preserve this invariable orientation over time, which allows better control of the mixing.

The transmission 18 makes it possible to turn the mixing members 22 about the second axis 15 without the drive unit being close to the mixing members 22. This makes it possible to move the drive unit outside the container 30. The advantage is ability to choose the power of the drive unit as well as its subsequent overall dimension regardless of the size of the container 30 and vice versa. The length of the first shaft 14 can be adjusted as a function of the desired position of the mixing members 22 in the container 30. The transmission 18 allows transmission of the rotation movement of the first shaft 14 to the second shaft 16. The transmission 18 is for example a gear system. The a gear system is for example of the bevel gear type The advantage of the bevel gearing is the ability to incline the axis 15 relative to the axis 13 by a desired angle.

The transmission 18 is in the casing 20 having substantially symmetry of revolution about the axis 13 of rotation of the casing 20. The ingredients present in the medium are thus not contaminated by the lubrication of the transmission 18. Moreover, the transmission 18 is itself protected by the casing 20 against the intrusion of ingredients.

Advantageously the transmission gearings can be chosen in such a way as to operate without lubrication. For example, it is possible to choose a gear, at the end of the first shaft 14, made from nitrided steel driving a gear on the second shaft 16 made from aluminium bronze.

The casing 20 having substantially a symmetry of revolution, is for example spherical. The sphere has for example a diameter of 100 mm to 500 mm. Advantageously, the casing can be droplet-shaped. The base of the casing 20 is then spherical and its connection to the transmission tube 12 is tapered. The advantage is that the connection does not have any recesses in which the ingredients of the medium can remain tapped.

The mixing members 22 will now be described in more detail. According to FIG. 2, the mixing members 22 can be open-worked vanes. This embodiment allows the mixing of non-miscible viscous ingredients such as pieces of fruit and yoghurt. According to another variant, the mixing members 22 can be solid vanes. This embodiment makes it possible to carry out an ordered mixing, i.e. an order is conferred upon the particles of ingredients in the mixture. According to yet another embodiment, the mixing members 22 can be cutters. This embodiment makes it possible to obtain a shearing effect, which is advantageous when the ingredients are powdery. The number of vanes depends on the product to be mixed and its viscosity. In particular, if it is wished to reduce the phenomenon of attrition (modification of the structure of the particles), the number of vanes is increased.

As FIG. 2 shows, the shape of the mixing members 22 can be adapted to the shape of the container, so as to minimize the dead zones in the container 30. As the members 22 are driven in rotation, they describe a circular movement. For this reason, the base of the container has a symmetry of revolution—about the first axis 13—and its generatrix is the extreme edge of a mixing member 22; in the example, the base of the container is spherical and the extreme edge of the mixing members is an arc of a circle.

A lump breaker 26 will be described next in relation to the mixer described previously. However, the lump breaker can be used independently of the mixer as described above. In particular, the lump breaker can be used independently of the symmetry of revolution of the casing.

FIG. 2 shows the mixer 10 comprising the lump breaker 26 thus making it possible to carry out granulation. The lump breaker 26 makes it possible to break up the lumps of ingredients that are likely to form in the container 30.

The lump breaker 26 is mobile relative to the first axis 13, the lump breaker 26 and the mixing members 22 being on either side of a plane P (FIG. 3) containing the axis 13.

The arrangement of the members 22 and the lump breaker 26 on either side of the plane P prevents the two members from striking each other. Another advantage is that the ingredients are propelled by the mixing members 22 towards the lump breaker 26, the lumps are broken up better and the granulation is achieved more rapidly.

The lump breaker 26 is mobile relative to the first axis 13 in such a way that the lump breaker 26 can move parallel to the axis 13 as well as in a plane perpendicular to the first axis 13. The advantage is that the position of the lump breaker 26 can thus vary in the container 30. The position of the lump breaker 26 can vary in height in particular in order to break up lumps which have fallen to the base of the container.

In order to promote granulation, a sprayer 38 (FIG. 2) can be fixed on the container 30 in order to spray onto the ingredients a binding agent such as starch for example.

Figure 3:
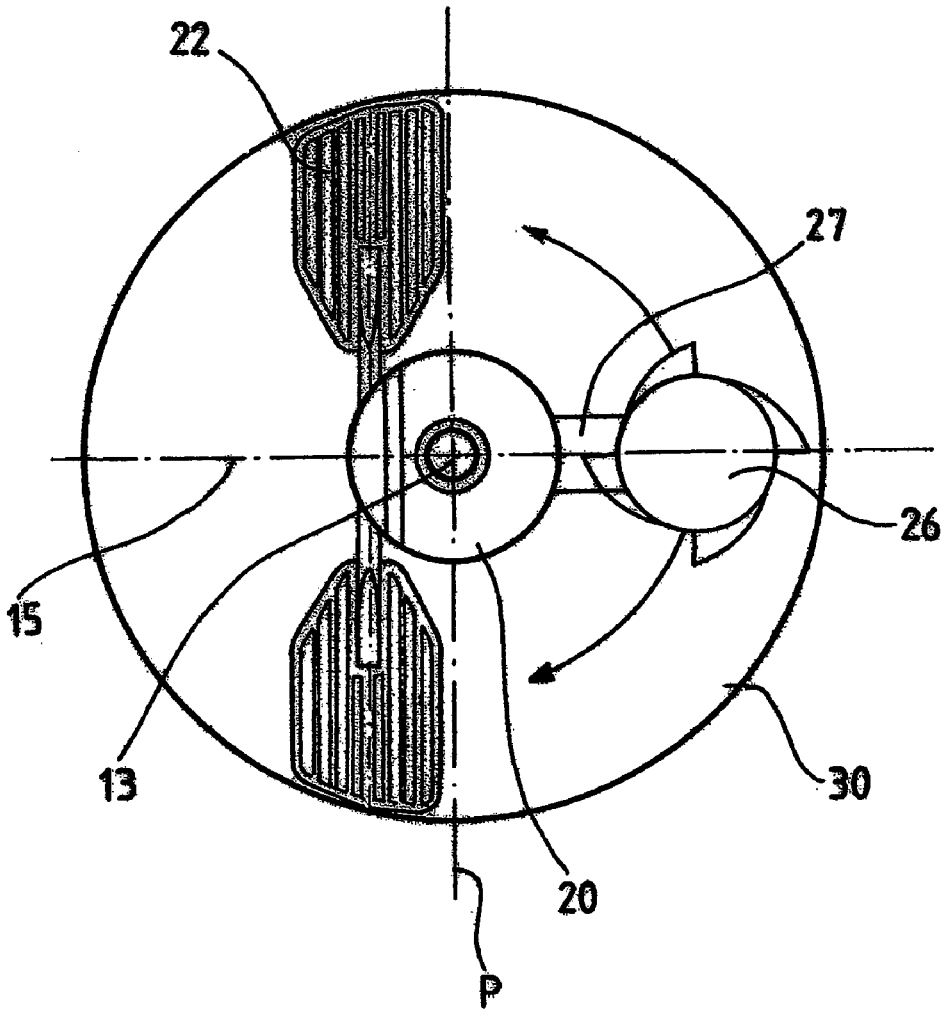
FIG. 3, a diagrammatic top view of the mixer of FIG. 2.

FIG. 3 shows a diagrammatic top view of the mixer of FIG. 2. FIG. 3 illustrates by the various arrows possible positions which the lump breaker 26 can occupy in the plane perpendicular to the axis 13. The lump breaker 26 can occupy any position which does not impede the rotation of the mixing members 22. This allows a wide range of possible positions for the lump breaker 26 in the container 30. Preferably, the lump breaker 26 is along the axis 15. In this way, the lump breaker 26 is aligned with the casing 20 and the axis of rotation of the mixing members 22. This arrangement is particularly advantageous as the lump breaker 26 is situated substantially in the centre of the stream of ingredients leaving the mixing members 22. In this position the lump breaker is at its most effective.

According to FIGS. 2 and 3, the lump breaker 26 is preferably connected to the transmission tube 12. This connection offers the advantage that the lump breaker 26 is driven in rotation simultaneously with the mixing members 22 in the movement about the axis 13 according to θ. Thus the mixing members 22 and the lump breaker 26 cannot collide, which protects them whilst ensuring a satisfactory mixing of the ingredients. Moreover, the connection between the transmission tube 12 and the lump breaker 26 allows the lump breaker 26 to be situated permanently on the other side from the members 22 relative to the axis 13 and thus to be in the stream of ingredients leaving the mixing members. Also, the connection of the lump breaker 26 to the transmission tube 12 allows the lump breaker 26 to benefit from being driven by the drive unit 32 without requiring the use of an additional drive unit.

The lump breaker 26 is for example connected to the transmission tube 12 by an arm 27. The arm 27 is advantageously telescopic. Such an arm allows an easy change of position of the lump breaker 26 by deploying the arm. The arm is advantageously bent and has an substantially horizontal portion and an substantially vertical portion. The substantially horizontal portion makes it possible to displace the lump breaker 26 in the plane perpendicular to the axis 13 and the substantially vertical portion makes it possible to displace the lump breaker 26 along the axis 13.

Advantageously, the lump breaker 26 can be displaced during the operation of the mixer 10. For example, a camera makes it possible to display the inside of the container 30 and consequently to modify the position of the lump breaker 26 in the container. A control makes it possible to act on the horizontal and vertical portions of the telescopic arm 27.

The lump breaker 26 makes it possible to break up the lumps of ingredients and to limit lumps in the mixture. For this purpose, the lump breaker 26 comprises vanes driven in rotation and reducing the lumps to powder. The lump breaker 26 is driven in rotation by an electric motor preferably in the telescopic arm 27. The drive speed of the electric motor can reach for example 3000 rpm. This makes it possible to prevent transmission of the rotation movement to the lump breaker 26 via the transmission tube 12 and arm 27.

FIGS. 4 to 8 are views of different embodiments of the lump breaker 26 with different cutting members. The spacing of the cutting members makes it possible to define the size of the granules.

Figure 4:
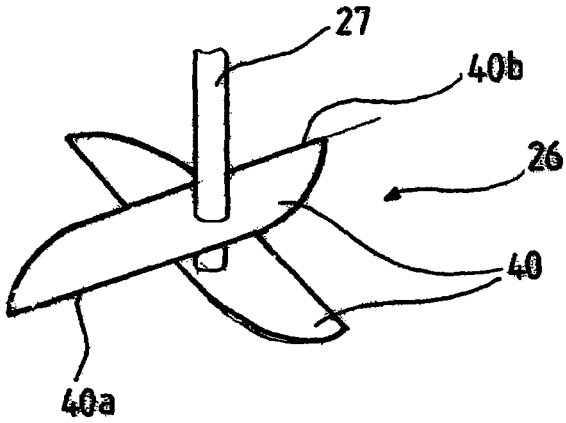
FIGS. 4 to 8, views of a lump breaker.

FIG. 4 shows the lump breaker 26 comprising cutters 40 extending radially relative to the arm 27 and along the arm 27. The cutters make it possible to break up the lumps and obtain a random granulation The cutters may or may not run in parallel directions. The cutters have for example two sharp edges 40*a* and 40*b* for slicing on either side of the cutters. According to the arrangement of the sharp edges in FIG. 4, the lump breaker 26 is driven in rotation in the trigonometric sense in such a way that the sharp edges slice the lumps. The number of cutters 40 depends on the granulation to be obtained.

Figure 5:
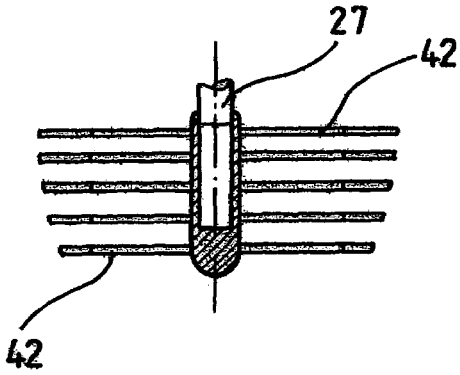
Figure 6:
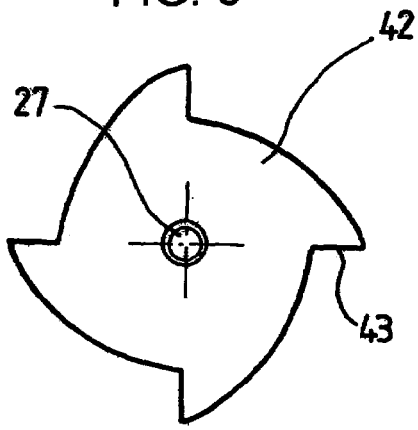

FIG. 5 shows the lump breaker 26 comprising discs 42 superposed along the arm 27. FIG. 6 is a top view of a disc 42. The discs 42 allow breaking up of the lumps and calibration of the granulation. The discs have at least one sharp edge 43. According to the arrangement of the sharp edges in FIG. 5, the lump breaker 26 is driven in rotation clockwise in such a way that the sharp edge slices the lumps. The number of discs 42 and sharp-edges 43 depends on the granulation to be obtained.

Figure 7:
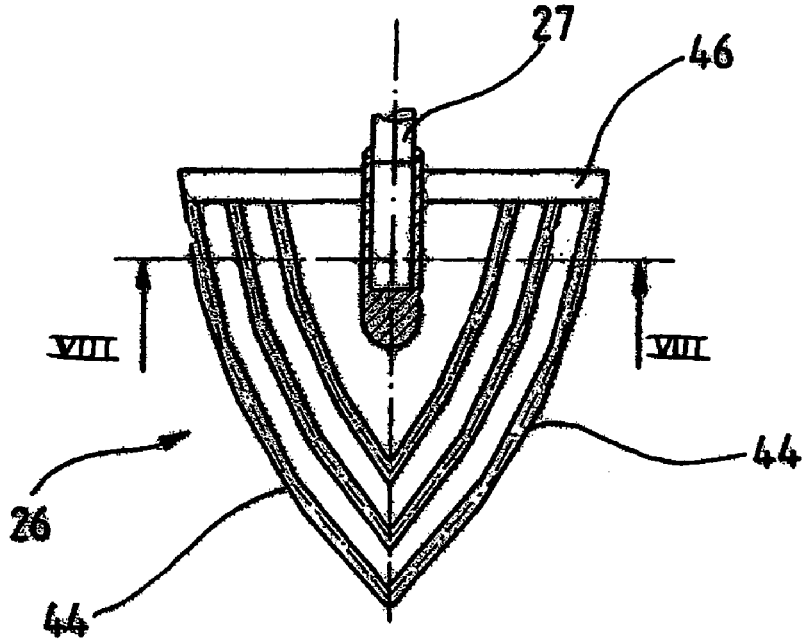
Figure 8:
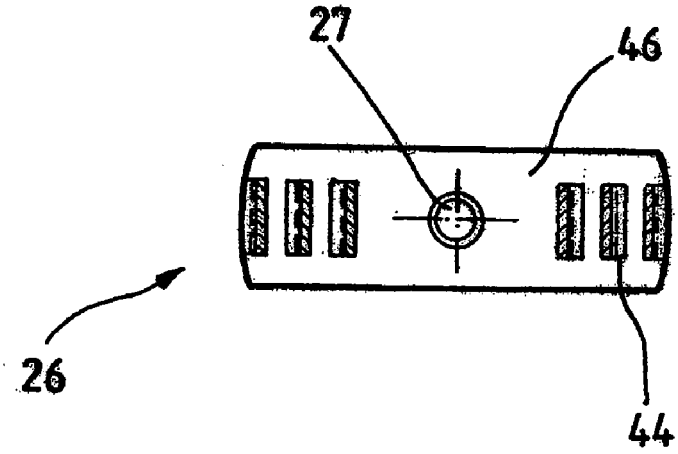

FIG. 7 shows the lump breaker 26 comprising forks 44. FIG. 8 is a section A—A according to FIG. 7. The forks allow the lumps to be broken up. The forks also make it possible to create the phenomenon of attrition in order to round off the granules. The forks are arranged on a support 46 and are regularly spaced along the support. The support 46 is non-limitatively rectangular in FIG. 8. The number of forks 44 is variable and depends on the granulation to be obtained. According to FIG. 7, the forks extend towards the base of the container and are curved inwards towards the axis of the arm 27. This shape makes it possible to follow to a spherical shape of the base of the container 30 and to get as close as possible to the edge of the container 30.

Figure 9:
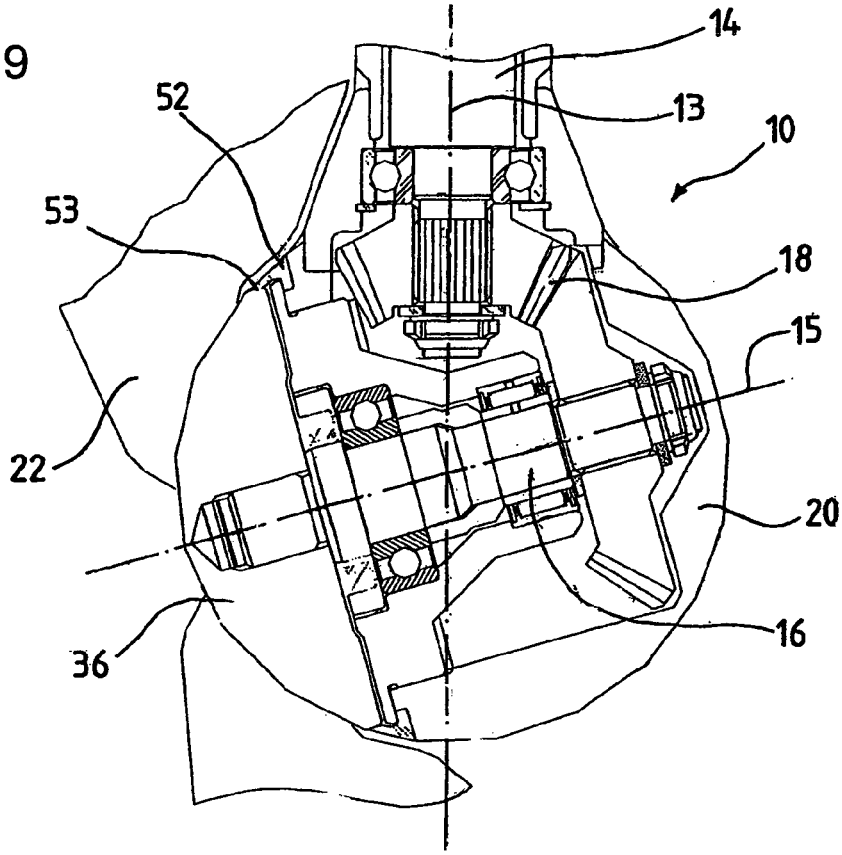
FIGS. 9 and 10, views of joints.
Figure 10:
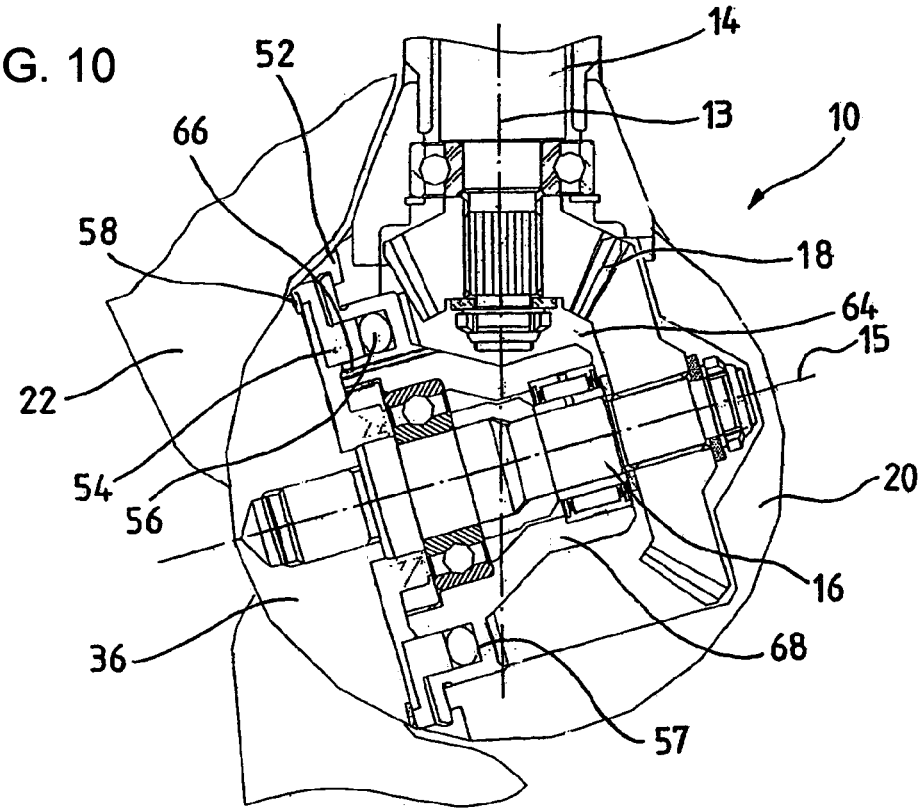

FIGS. 9 and 10 show joints between the cap 36 and the rest of the casing 20. FIG. 9 shows a circular gasket 52 the lips 53 of which come to rest on the cap 36. The gasket ensures tightness against the ingredients present in the container 30. The gasket is for example made from PTFE resistant up to 400° C. The gasket 52 also makes it possible to confer on the junction between the cap 36 and the rest of the casing 20, an approximate symmetry of revolution about the axis 13, at the junction between the casing 20 and the cap 36.

FIG. 10 shows another embodiment of a gasket A circular joining piece 54 is arranged on the casing 20 in such a way as to rest against the cap 36. When the cap 36 is mounted on the casing 20, the joining piece 54 compresses a spring 56, for example toroidal, arranged at the base of a groove 57 of the casing 20. Thus the joining piece 54 is pressed against the cap 36 in such a way as to promote the sealing of the casing 20 against the ingredients in the container 30. Preferably, the joining piece 54 is pressed against a ring gasket 58 arranged on the periphery of the surface of the cap 36 in contact with the joining piece 54. The seal is thus improved. In operation, the cap 36 is driven in rotation with the ring gasket 58 against the joining piece 54. As an illustration, the joining piece 54 can made of steel and the ring gasket 58 can be made of elastomer. In order to improve the seal between the joining piece 54 and the casing 20, the lips 53 of the gasket 52 can come to rest on the joining piece 54. The gasket 52 also makes it possible to confer upon the junction between the cap 36 and the rest of the casing 20, substantial symmetry of revolution about the axis 13, at the junction between the casing 20 and the cap 36.

In order to improve the contact between the joining piece 54 and the ring gasket 58, the mixer 10 can comprise gasket lubricant The lubricant is for example a neutral nitrogen or argon-type gas, making it possible to prevent pollution of the ingredients in the container. In FIG. 2, the lubricant is injected through an orifice 60 into a conduit 62 extending along the shaft 14. In FIG. 10, the lubricant enters the casing 20 into a cavity 64. The lubricant finally reaches the contact surface between the joining piece 54 and the ring gasket 58 through a hole 66 made in a support 68 of the shaft 16.

The invention also relates to an apparatus comprising the mixer 10 as described previously, comprising or not comprising the lump breaker 26. The apparatus comprises a container 30 the base of which has a symmetry of revolution and the generatrix of which is the extreme edge of a mixing member 22.

The apparatus is suitable for the rapid and efficient mixing of liquid or solid materials, for example powders. Given below are the results of mixing tests in the apparatus of the type in FIG. 2, without the lump breaker 26, for a mixture of flour with puffed corn or with ascorbic acid.

In the first test, flour was mixed with puffed corn. These products are characterized by a considerable difference in density, making for difficult mixing. The ingredients are mixed for 30 seconds. Then, after sieving (200 μm sieve) four samples are taken and analyzed. The results of the tests are shown in Table 1.

| | % puffed corn |
|---|---|
| Sample 1 | 7.80% |
| Sample 2 | 8.10% |
| Sample 3 | 7.90% |
| Sample 4 | 7.70% |

This test shows a good distribution of the puffed corn.

In the second test, 4 g of ascorbic acid (E300) are mixed with 100 kg of flour for 30 seconds. Then, four samples of mixture are taken and analyzed in order to quantify the incorporation of the ascorbic acid into the flour (determined by the dichloroindophenol method). The test results are shown in Table 2 (g/q signifying gram/quintal).

| | quantity of E300 in g/100 kg of flour |
|---|---|
| Sample 1 | 3.72 |
| Sample 2 | 3.96 |
| Sample 3 | 4.01 |
| Sample 4 | 3.69 |

This test shows a good distribution of the E300 in the flour after 30 seconds' mixing.

The apparatus comprising the mixer 10 equipped with the lump breaker 26 also makes it possible to carry out the granulation steps rapidly.

Figure 11:
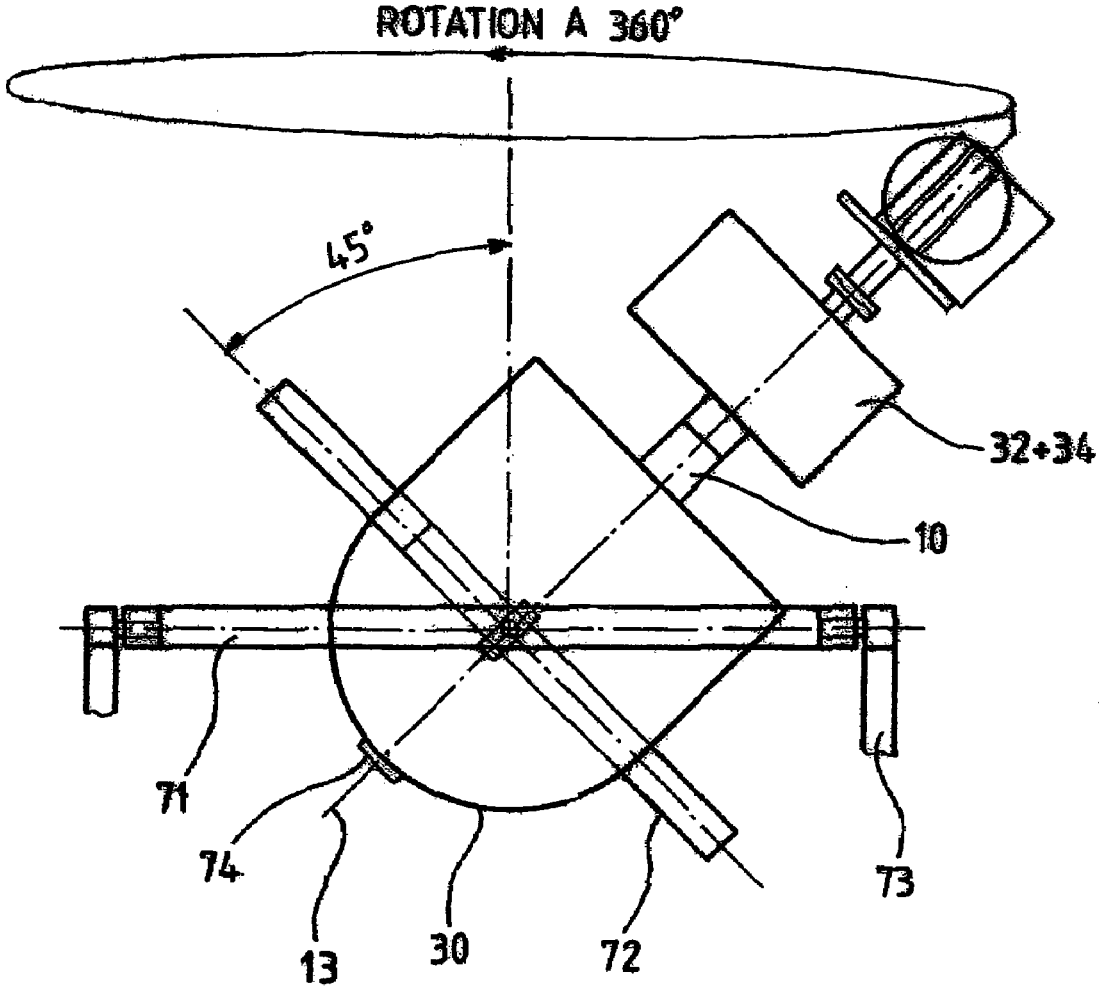
FIG. 11, a view of the apparatus according to an embodiment of the invention

FIG. 11 also shows another embodiment of the apparatus; in the embodiment of the invention, the assembly comprising the mixer and its container is mounted on two concentric cradles 71 and 72. The inner cradle supports the container 30 and the mixer 10. The inner cradle is mounted on the outer cradle in rotation about a diameter common to the inner and outer cradles; in the figure, this diameter is perpendicular to the plane of the page. The outer cradle is mounted in rotation on a support 73, in rotation about a diameter of the outer cradle perpendicular to the diameter on which the inner cradle is mounted. The assembly of the two cradles makes it possible to position the container 30 and the mixer 10 at any angle. The figure shows moreover an outlet 74 situated in the base of the container.

In the embodiment of the figure, the two cradles are concentric at a point which is the intersection of the axes 13 and 15. Another fixed point could also be chosen for the assembly of mixers.

The arrangement of FIG. 11 makes it possible to combine a rotation movement of the container and the mixer, with the movement of the mixing members. In this way, dead masses and the deposition of mixed material on the walls of the container are avoided. This makes it possible in particular to avoid the use of a scraper.

Of course, the present invention is not limited to the embodiments described by way of example. Thus, the lump breaker can be used irrespective of the shape of the casing. The lump breaker can be used on existing mixers.

What is claimed is:

1. A mixer comprising:

a casing substantially having symmetry of revolution about a first axis, mixing members driven in rotation relative to the casing and about a second axis that is inclined relative to the first axis, a lump breaker which is mobile relative to the first axis, the lump breaker and the mixing members being on either side of a plane containing the first axis, the casing and the mixing members being driven in rotation about the first axis at a determined speed.

2. The mixer according to claim 1, wherein the casing comprises a cap driven in rotation about the second axis and supporting the mixing members.

3. The mixer according to claim 1, characterized by a first drive unit for driving the casing and mixing members about the first axis and a second drive unit for driving the mixing members about the second axis.

4. The mixer according to claim 3, wherein the first and second drive units are superposed along the first axis.

5. The mixer according to claim 1, wherein the second axis is inclined relative to the first axis by an angle comprised between 45° and 90° in the trigonometric sense.

6. The mixer according to claim 1, wherein the mixing members have an orientation which is variable relative to the second axis.

7. The mixer according to claim 1, wherein the mixing members have an orientation which is fixed relative to the second axis.

8. The mixer according to claim 1, wherein the mixing members have an extreme edge in the shape of an arc of a circle.

9. The mixer according to claim 1, characterized by:

a transmission tube driven in rotation about the first axis and carrying at one end the casing, a first shaft, in the transmission tube, driven in rotation about the first axis, a second shaft driven in rotation about the second axis by the first shaft, the second shaft driving in rotation the mixing members, a transmission connecting the first and second shafts, the transmission being in the casing.

10. The mixer according to claim 1, wherein the mixing members are open-worked vanes.

11. The mixer according to claim 1, wherein the mixing members are solid vanes.

12. The mixer according to claim 1, wherein the mixing members are cutters.

13. The mixer according to claim 1, wherein the lump breaker is mobile parallel to the first axis.

14. The mixer according to claim 1, wherein the lump breaker has an axis, the axis of the lump breaker and the second axis being secant.

15. The mixer according to claim 1, wherein the lump breaker is connected to a transmission tube.

16. The mixer according to claim 15, wherein a telescopic arm connects the lump breaker to the transmission tube.

17. The mixer according to claim 16; wherein the lump breaker is driven in rotation by a motor in the telescopic arm.

18. An apparatus comprising a mixer comprising a casing substantially having symmetry of revolution about a first axis, mixing members driven in rotation relative to the casing and about a second axis that is inclined relative to the first axis, a lump breaker which is mobile relative to the first axis, the lump breaker and the mixing members being on either side of a plane containing the first axis, the casing and the mixing members being driven in rotation about the first axis at a determined speed, and a container the base of which has a symmetry of revolution and the generatrix of which is the extreme edge of a mixing member.

19. The apparatus according to claim 18, wherein the apparatus has an inner cradle supporting the container and the mixer and mounted on an outer cradle in rotation about a diameter common to the inner and outer cradles, and a support, the outer cradle being mounted in rotation about a diameter on said support.

* * * * *